US012545482B2

(12) United States Patent
Lee et al.

(10) Patent No.: US 12,545,482 B2
(45) Date of Patent: Feb. 10, 2026

(54) STRUCTURE FOR SEALING AND DISPENSING CLEANING ARTICLES

(71) Applicant: Kimberly-Clark Worldwide, Inc., Neenah, WI (US)

(72) Inventors: JongSoo Jacob Lee, Taoyuan (TW); Ming-Huang Lin, Taoyuan (TW); Traneil C. Morgan, Woodstock, GA (US); Thomas H. Schulz, Roswell, GA (US); Ning Yang, Suwanee, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 18/261,526

(22) PCT Filed: Nov. 19, 2021

(86) PCT No.: PCT/US2021/060086
§ 371 (c)(1),
(2) Date: Jul. 14, 2023

(87) PCT Pub. No.: WO2023/091141
PCT Pub. Date: May 25, 2023

(65) Prior Publication Data

US 2024/0262579 A1 Aug. 8, 2024

(51) Int. Cl.
*B65D 47/08* (2006.01)
*A47K 10/32* (2006.01)
(Continued)

(52) U.S. Cl.
CPC ..... *B65D 47/0842* (2013.01); *A47K 10/32* (2013.01); *B65D 51/20* (2013.01);
(Continued)

(58) Field of Classification Search
CPC ..... A47K 10/421; A47K 2010/3266; B65D 43/161; B65D 51/18; B65D 51/20; B65D 83/08; B65D 2251/1058; B65D 47/0842
See application file for complete search history.

(56) References Cited

U.S. PATENT DOCUMENTS 2,765,094 A * 10/1956 Ryan ..... B65D 47/0895 215/DIG. 5
3,235,165 A * 2/1966 Jackson ..... B65D 51/20 229/125.05
(Continued)

FOREIGN PATENT DOCUMENTS

CN 206172183 U 5/2017
FR 2408333 A1 6/1979
(Continued)

OTHER PUBLICATIONS

PCT Search Report Corresponding to Application No. PCT/US2021/060086 on Mar. 22, 2022.
(Continued)

*Primary Examiner* — Gene O Crawford
*Assistant Examiner* — Kelvin L Randall, Jr.
(74) *Attorney, Agent, or Firm* — Dority & Manning, P.A.

(57) ABSTRACT

A sealing and dispensing structure for a container for storing and dispensing cleaning articles includes a sealing and dispensing structure. The sealing and dispensing structure includes a floor defining a bottom of the sealing and dispensing structure and a perimetric flange adjoined to the floor at an interior bottom. The perimetric flange and the floor at least partially defining a side and a bottom of a dispensing compartment. The sealing and dispensing structure further includes a dispensing orifice extending through the floor for individually dispensing the cleaning articles into the dispensing compartment and an access orifice extending through at least a portion of the floor for accessing
(Continued)

the cleaning articles stored in the container. The sealing and dispensing structure also includes an outer lid having a size and shape adapted to mate with and seal an interior top of the perimetric flange and form a top of the dispensing compartment when in a closed position and an inner lid having a size and shape adapted to mate with and seal the access orifice and form at least a portion of a bottom of the dispensing compartment when in a closed position.

21 Claims, 4 Drawing Sheets

(51) Int. Cl.
*B65D 51/20* (2006.01)
*B65D 83/08* (2006.01)

(52) U.S. Cl.
CPC ..... *B65D 83/08* (2013.01); *A47K 2010/3266* (2013.01); *B65D 2251/1058* (2013.01)

(56) References Cited

U.S. PATENT DOCUMENTS 3,587,944 A * 6/1971 Pehr ..... B65D 83/06 220/259.2
3,979,020 A * 9/1976 Braber ..... B65D 83/0805 221/63
3,994,417 A 11/1976 Boedecker
4,462,507 A * 7/1984 Margulies ..... A47K 10/3818 206/409
4,526,291 A 7/1985 Margulies
4,955,513 A * 9/1990 Bennett ..... B65D 47/0847 222/480
7,806,292 B2 * 10/2010 Simkins ..... A47K 10/3818 221/39
D712,258 S * 9/2014 Grattagliano ..... D9/449
10,894,656 B2 * 1/2021 Lange ..... B65D 75/58
D940,560 S * 1/2022 Defois ..... D9/449
2001/0025865 A1 * 10/2001 Bravo ..... B65D 23/108 222/561
2003/0116582 A1 * 6/2003 Tosdale ..... A47K 10/3818 221/70
2004/0043165 A1 * 3/2004 Van Hulle ..... B32B 15/20 428/34.2
2005/0051663 A1 * 3/2005 Walters ..... A47K 10/38 242/597.8
2005/0205594 A1 * 9/2005 Evans ..... A47K 10/3818 221/63
2006/0283752 A1 12/2006 Alegre de Miquel
2008/0179326 A1 * 7/2008 Krauth ..... B65D 75/5872 221/154
2014/0021219 A1 * 1/2014 Honan ..... B65D 83/08 221/306
2014/0190859 A1 * 7/2014 Yamada ..... B65D 83/0894 206/494
2014/0367400 A1 * 12/2014 Crudge ..... A47K 10/38 221/63
2015/0305579 A1 * 10/2015 Azelton ..... B65D 85/62 221/63
2017/0150852 A1 * 6/2017 Park ..... A47K 10/421
2019/0313862 A1 * 10/2019 Jack ..... A47K 10/3836
2024/0115084 A1 * 4/2024 Lott, Sr. ..... F16B 47/00

FOREIGN PATENT DOCUMENTS

JP H0880980 A 3/1996
JP 2000355340 A 12/2000
JP 2012066873 A 4/2012
KR 20180117999 A 10/2018
WO WO2005112556 A2 12/2005
WO WO2021126198 A1 6/2021

OTHER PUBLICATIONS

Korean Office Action Corresponding to Application No. 10-2024-7019681 on Oct. 22, 2024.
European Search Report Corresponding to Application No. 21964952.2 on Jun. 12, 2025.

* cited by examiner

STRUCTURE FOR SEALING AND DISPENSING CLEANING ARTICLES

RELATED APPLICATIONS

The present application is the national stage entry of International Patent Application No. PCT/US2021/060086 having a filing date of Nov. 19, 2021, which is incorporated herein in its entirety by reference thereto.

BACKGROUND OF THE INVENTION

There are a variety of storing and dispensing containers in the market, particularly those for storing and dispensing cleaning articles. Cleaning articles, particularly wipes, have been made from a variety of materials which can be dry or wet when used. Wet wipes can be moistened with a variety of suitable wiping solutions. Typically, wet wipes have been placed in containers in the form of a continuous web of material which includes perforations to separate the individual wet wipes and which is wound into a roll. Cleaning articles, such as wet wipes have been used for baby wipes, hand wipes, household cleaning wipes, industrial wipes and the like.

Wet wipes have also been stacked in a container in either a folded or unfolded configuration. For example, containers of wet wipes have been available wherein each of the wet wipes stacked in the container has been arranged in a folded configuration such as a c-folded, Z-folded or quarter-folded configuration as are well known to those skilled in the art. Sometimes the folded wet wipes have also been interfolded with the wet wipes immediately above and below in the stack of wet wipes.

The conventional containers which contain wipes have typically been designed to be positioned on a flat surface such as a countertop, table or the like. Such conventional packages have generally provided a plastic container, tub or package which provides a sealed environment for the wet wipes to reduce the likelihood that they become dirty and/or prematurely dry. To access the wipes, many containers have an access lid that is opened by pressing a button or releasing a latch on the top of the container. Some of these conventional packages have been configured to provide one at a time dispensing of each wet wipe which can be accomplished using a single hand after the container has been opened. Such single handed, one at a time dispensing is particularly desirable because the other hand of the user or care giver is typically required to be simultaneously used for other functions. For example, when changing a diaper product on an infant, the care giver typically uses one hand to hold and maintain the infant in a desired position while the other hand is attempting to dispense a wet wipe to clean the infant. The care giver may not want to look away from the infant to open the container and access the wipes.

A wide variety of wet wipes dispensing containers are available in the market today. These containers may be broadly categorized into two classes: reach-in and pop-up. Reach in containers provide a roll of wipes, perforated at their edges, which are dispensed from an upright cylindrical container. Within the pop-up category, some containers provide a stack of flat interfolded wipes, which are most commonly dispensed from a tub.

However, the dispensing of wipes from such conventional containers for wipes has not been completely satisfactory. For example, for reach in containers the consumer needs to reach within the contain to begin the feeding of the wipes (or restart the feeding of the wipes if there is a failure). This necessitates a relatively large opening through the lid to access the person care product. Likewise, for pop-up style containers having a stack of wipes there are occasions where the pop-up feature fails, and the user needs to reach into the container to retrieve the next wipe. In both types of containers, these large openings provide a path for the wipes to become contaminated and allow the wipes to dry out during storage prior to use by the consumer. Therefore, there is a need to provide a dispenser with a sealing and dispensing structure which allows consumers access to the wipes for easier dispensing when necessary while also allowing this access orifice to be closed when not in use. In this manner, the incidence of contamination and premature drying of the wet wipes may be reduced.

SUMMARY OF THE INVENTION

In response to the aforementioned needs, a sealing and dispensing structure for a container for storing and dispensing cleaning articles has been invented. In particular embodiments, the sealing and dispensing structure for a container for storing and dispensing cleaning articles includes a floor defining a bottom of the sealing and dispensing structure and a perimetric flange adjoined to the floor at an interior bottom. The perimetric flange and the floor at least partially define a side and a bottom of a dispensing compartment. The sealing and dispensing structure further includes a dispensing orifice extending through the floor for dispensing individual cleaning articles (e.g., wipes) into the dispensing compartment and an access orifice extending through at least a portion of the floor for accessing the cleaning articles stored in the container. The sealing and dispensing structure also includes an outer lid having a size and shape adapted to mate with and seal an interior top of the perimetric flange and form a top of the dispensing compartment when in a closed position and an inner lid having a size and shape adapted to mate with and seal the access orifice and form at least a portion of a bottom of the dispensing compartment when in a closed position.

In particular embodiments, the outer lid is connected to the perimetric flange by at least one outer lid hinge having an outer lid hinge axis, the at least one outer lid hinge allowing the outer lid to be reversibly rotated around the outer lid hinge axis between an open position and the closed position. The outer lid seals the interior top of the perimetric flange with a pressure seal or a friction seal (or other mechanical engagement-type seal, e.g., hook and loop) or an adhesive-type seal. In some embodiments, the outer lid includes a latch and the perimetric flange includes a receiving notch adapted to receive the outer lid latch to reversibly lock the outer lid in the closed position.

In particular embodiments, the inner lid connected to the perimetric flange by at least one inner lid hinge having an inner lid hinge axis, the at least one inner lid hinge allowing the inner lid to be reversibly rotated around the inner lid hinge axis between an open position and the closed position. The outer lid seals the interior top of the perimetric flange with a pressure seal or a friction seal (or other mechanical engagement-type seal, e.g., hook and loop) or an adhesive-type seal. In some embodiments, the inner lid also includes a latch and access orifice includes a receiving notch adapted to receive the inner lid latch to reversibly lock the inner lid in the closed position.

In a particular embodiment, a sealing and dispensing structure for a container for storing and dispensing cleaning articles is provided. The sealing and dispensing structure including a floor: a perimetric flange around the floor: a dispensing orifice: an access orifice: an outer lid; and an inner lid. The floor defines a bottom of the sealing and dispensing structure. The perimetric flange has an exterior wall and an interior wall, the interior wall has an interior perimeter, a bottom, and a top, the floor is adjoined to the perimetric flange at the bottom of the interior wall, the interior wall defining a circumference of a dispensing compartment and the floor at least partially defining a bottom of a dispensing compartment. The dispensing orifice extends through the floor for dispensing individual cleaning articles into the dispensing compartment. The access orifice extends through at least a portion of the floor for accessing the cleaning articles stored in the container, the access orifice having an interior perimeter. The outer lid is connected to the perimetric flange by at least one outer lid hinge having an outer lid hinge axis that allows the outer lid to be reversibly rotated around the outer lid hinge axis between an open position and a closed position. The outer lid has a size and shape adapted to mate with the top of the interior perimeter of the interior wall and form a top of the dispensing compartment when in the closed position. The inner lid is connected to the perimetric flange by at least one inner lid hinge having an inner lid hinge axis that allows the inner lid to be reversibly rotated around the inner lid hinge axis between an open position and a closed position. The inner lid having a size and shape adapted to mate with the interior perimeter of the access orifice and form at least a portion of a bottom of the dispensing compartment when in the closed position.

In particular embodiments, a container for storing and dispensing cleaning articles the sealing and dispensing structure and a housing for storing the cleaning articles is provided. In one embodiment, the perimetric flange is adapted to connect to the housing and the perimetric flange and the housing are connected. In another embodiment, the housing and the perimetric flange are unitary. The cleaning articles, such as wet wipes, pre-moistened towelettes, cleaning cloths, [OTHERS?] and the like, are stored in the housing. The container may also include a disposable seal sealing the dispensing orifice, the access orifice, or both.

In particular embodiment, the access orifice comprises greater than 30% of the surface area of the floor. In another embodiment, the ratio of the surface area of the access orifice to the dispensing orifice is about 5 to 1 or greater.

BRIEF DESCRIPTION OF THE DRAWINGS

The present invention will be more fully understood and further features will become apparent when reference is made to the following detailed description of the invention and the accompanying drawings. The drawings are merely representative and are not intended to limit the scope of the claims. Like parts of the containers depicted in the drawings are references by the same reference numerals.

DETAILED DESCRIPTION OF THE INVENTION

Figure 1:
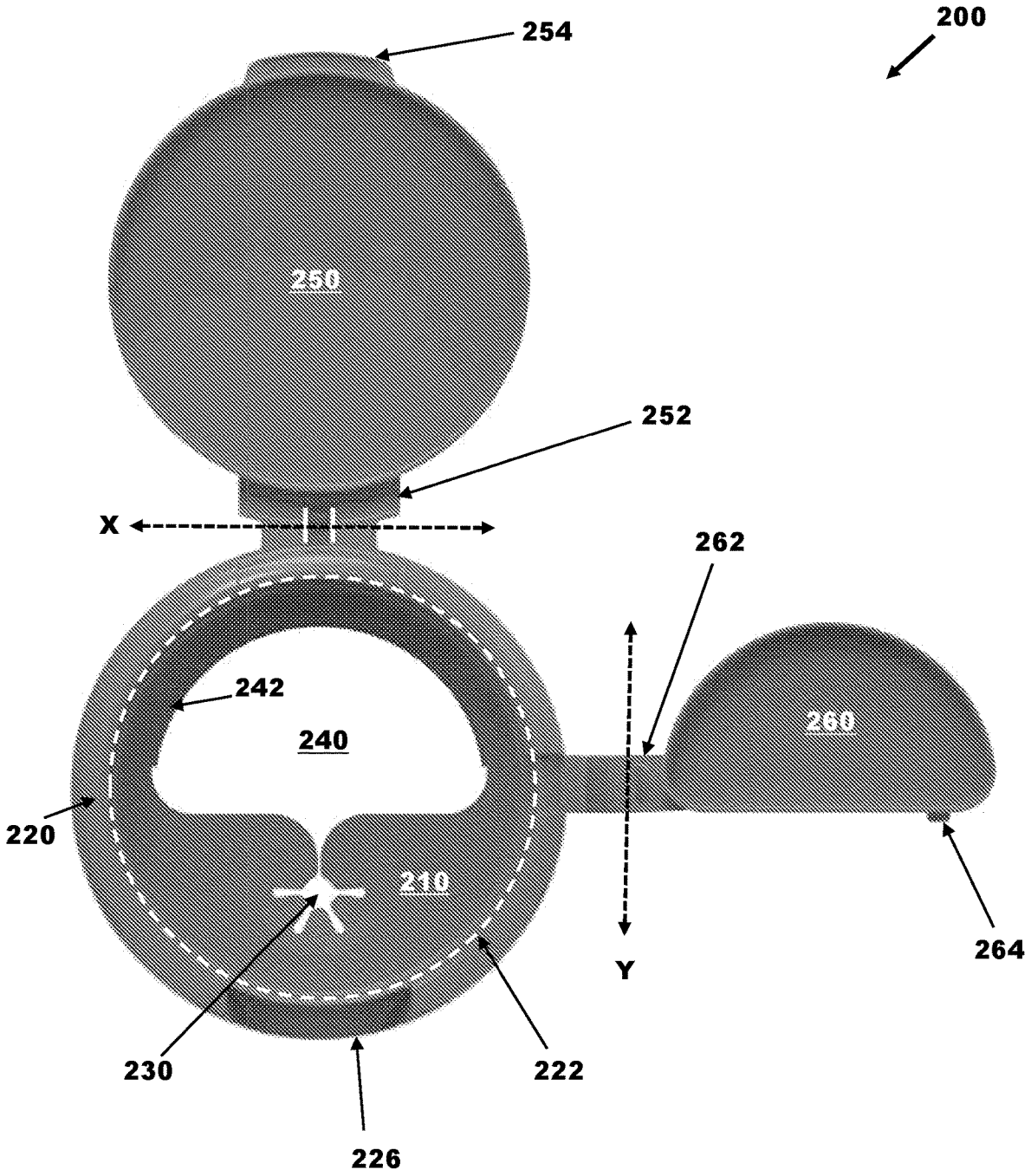
FIG. 1 representatively shows a top view of the sealing and dispensing structure with the inner lid and outer lid each in the open positions.

The present invention is directed at solving problems related to storing and dispensing product such as wipes and wet wipes from containers, and to solving problems related to the contamination and drying of such wipes in containers. As representatively illustrated throughout FIGS. 1 through 4, the present invention provides a storing and dispensing container 100 for cleaning articles 400. The cleaning articles 400 could be a variety of pliable type items, such as wipes, wet wipes, or other items where single-unit dispensing is desired. The container 10 generally includes a housing 300 and a sealing and dispensing structure 200. The housing 300 can be rigid (such as a plastic tub) or flexible (such as a pouch).

Referring to FIGS. 1 through 4, a container 100 includes a sealing and dispending structure 200 and a housing 300 containing cleaning articles 400.

The sealing and dispensing structure 200 includes a floor 210 defining a bottom of the sealing and dispensing structure and a perimetric flange 220 adapted to connect to the housing 300 for storing the cleaning articles 400 and adjoined to the floor 210 at an interior bottom. The perimetric flange 220 and the floor 210 at least partially defining a side and a bottom of a dispensing compartment 270. The sealing and dispensing structure 200 further includes a dispensing orifice 230 extending through the floor 210 for individually dispensing the cleaning articles 400 from the housing 300 into the dispensing compartment 270 and an access orifice 240 extending through at least a portion of the floor 210 for accessing the cleaning articles 400 stored in the housing 300. The sealing and dispensing structure 200 also includes an outer lid having 250 a size and shape adapted to mate with and seal an interior top of the perimetric flange 220 and form a top of the dispensing compartment 270 when in a closed position and an inner lid 260 having a size and shape adapted to mate with and seal the access orifice 240 and form at least a portion of a bottom of the dispensing compartment 270 when in a closed position.

Figure 2:
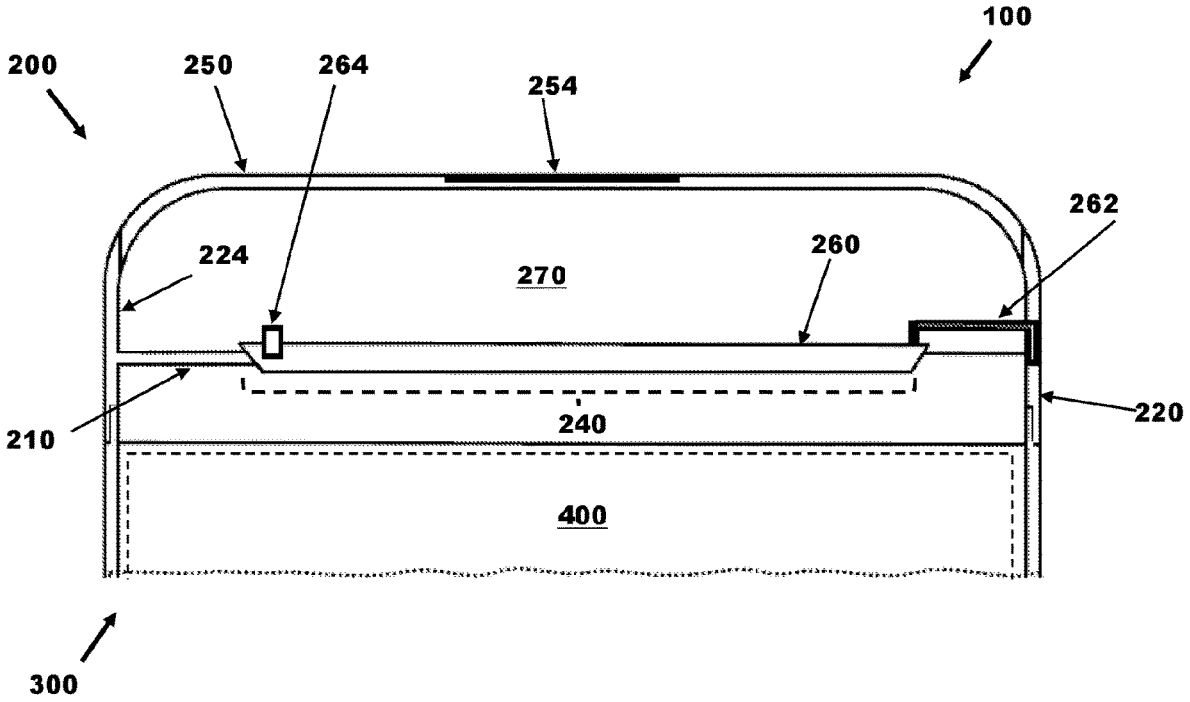
FIG. 2 representatively shows from, cross-section view of the sealing and dispensing structure affixed to a housing with the inner lid and outer lid each in the closed position.

As exemplified in FIG. 2, the sealing and dispensing structure 200 includes a dispensing compartment 270 bounded on the bottom by the floor 210 and inner lid 260 (when in the closed position), bounded on the top by the outer lid 250 (when in the closed position), and bounded on the perimeter 222 by the interior wall 224 of the perimetric flange 220. The interior wall 224 of the perimetric flange 220 is connected to the floor 210 at an interior bottom of the perimetric flange. Thus, the dispensing compartment 270 is separated from the interior of the housing 300 by the floor 210 and inner lid 260 (when closed). When in this fourth condition (discussed below), only the leading edge of a single person care article 400 is within the dispensing compartment 270 and the dispensing compartment 270 is closed to the environment. The dispensing compartment 270 may be accessed by moving the outer lid 250 to an open position (the third condition discussed below) to allow access to the leading edge of the cleaning article therein. Accordingly, the dispensing compartment 270 affords convenient dispensing of the cleaning articles 400 while providing as much protection from contamination and drying as possible to for cleaning articles 400 stored in the housing 300.

In exemplary embodiment, the dispensing orifice 230 is any opening through the floor 210 of the sealing and dispensing structure 200, which allows the dispensing of a single cleaning article 400. As exemplified in FIGS. 1 and 4, the dispensing orifice 230 has a nozzle with ribs shaped or a star shaped opening with one leg extending into the access orifice 240. This shape allows the leading edge of a single cleaning article 400 to be drawn up through the access orifice 240 and seated into the dispensing orifice 230. The shape of the dispensing orifice 230 further allows the user to pull the remainder of the cleaning article 400 out of the housing for use, while at the same time, drawing the leading edge of the next cleaning article 400 through the dispensing orifice 230 and into the dispensing compartment 270. The tension provided by the dispensing orifice 230 aids in the separation of one cleaning article 400 from the next when drawn through the dispensing orifice 230.

In exemplary embodiments, the dispensing orifice 230 has a relatively small surface area as compared to the surface area of the floor 210 of the sealing and dispensing structure 200 and/or the access orifice 240. For example, dispensing orifice may have a surface area about 10% or less of the total surface area of the floor 210 of the sealing and dispensing structure 200, preferably about 20% or less or about 25% or less. In other exemplary embodiments, the ratio of the surface area of the access orifice 240 to the dispensing orifice 230 is about 4 to 1 or greater, preferably about 5 to 1 or greater or about 10 to 1 or greater.

In exemplary embodiment, the access orifice 240 is any opening through the floor 210 of the sealing and dispensing structure 200 that allows the consumer to access the cleaning articles 400 stored in the housing 300. Access to the cleaning articles 400 stored in the housing 300 is typically required only to begin (or restart) the dispensing of the cleaning articles 400, as discuss above. Generally, the dispensing orifice 230 is too small to provide the access to the cleaning articles 400 stored in the housing 300 needed (i.e., the consumers fingers will not fit through the dispensing orifice 230). Accordingly, while no particular shape is required, the access orifice 240 is of a size and shape to allow the consumer to reach through the floor 210 and grasp a cleaning article 400 from at least the top of the roll or stack of cleaning articles 400 stored in the housing 300.

In exemplary embodiments, the access orifice 240 has a large surface area as compared to the surface area of the floor 210 of the sealing and dispensing structure 200. For example, dispensing orifice may have a surface area about 20% or greater of the total surface area of the floor 210 of the sealing and dispensing structure 200, preferably about 30% or greater or about 25% of greater or about 50% or greater. As exemplified in FIGS. 1, 2, and 4, the outer lid 250 has a size and shaped adapted to mate with and seal the top of the inner perimeter 222 of the perimetric flange 220. In particular embodiments, the inner perimeter 222 of the perimetric flange 220 is circular and the outer lid 250 is also circular and has a diameter fractionally smaller than the diameter of the inner perimeter 222 of the perimetric flange 220. In this manner, the edge of the outer lid 250 contacts with and seals to the inner perimeter 222 of the perimetric flange 220. The seal between the edge of the outer lid 250 and the inner perimeter 222 of the perimetric flange 220 may be maintained merely by the friction or pressure between the edge of the outer lid 250 and the inner perimeter 222 of the perimetric flange 220.

In exemplary embodiments, the outer lid 250 may be secured in the closed position by an outer lid latch 254 that engages a corresponding receiving notch 226 for the outer lid latch 254 on the perimetric flange 220. The outer lid latch 254 reversibly engages the receiving notch 226 for the outer lid latch 254 on the perimetric flange 220 and locks the outer lid in a closed position. The consumer may then disengage the outer lid latch 254 from the receiving notch 226 for the outer lid latch 254 on the perimetric flange 220 to open the outer lid 250. Such notches and latches of this type are known in the art.

In particular embodiments, the outer lid 250 is attached to the perimetric flange 220 by any means that allows the outer lid to be reversibly moved from the open position to the closed position. Such means are known in the art, and include hinges (e.g., living hinges), flexible bands extending from the outer lid 250 to the perimetric flange 220, and chain-type linkages. As exemplified in FIGS. 1 and 4, the outer lid 250 is connected to the perimetric flange 220 by an outer lid hinge 252 having an outer lid hinge axis X. In operation, the outer lid hinge 252 allows the outer lid 250 to be reversibly rotated around the outer lid hinge axis X from the open position to the closed position and back. The hinge may include a mechanism that biases the outer lid 250 into either the open position or the closed position. Essentially, if the consumer leaves the outer lid 250 in a position between the open position and the closed position, then the outer lid 250 will automatically default the open position or the closed position, whichever is closest to the position the outer lid 250 was left by the consumer.

As exemplified in FIGS. 1 through 4, the inner lid 260 has a size and shaped adapted to mate with and seal the top of the inner perimeter 242 of the access orifice 240. In particular embodiments, the shape of inner perimeter 242 of the access orifice 240 and the edge of the inner lid 260 are the same and the edge of the inner lid 260 is fractionally smaller than the inner perimeter 242 of the access orifice 240. In this manner, the edge of the inner lid 260 contacts with and seals to the inner perimeter 242 of the access orifice 240. The seal between the edge of the inner lid 260 and the inner perimeter 242 of the access orifice 240 may be maintained merely by the friction or pressure between the edge of the inner lid 260 and the inner perimeter 242 of the access orifice 240.

In exemplary embodiments, the inner lid 260 may be secured in the closed position by an inner lid latch 264 that engages a corresponding receiving notch (not shown) for the inner lid latch 264 on the inner perimeter 242 of the access orifice 240. The inner lid latch 264 reversibly engages the receiving notch for the inner lid latch 264 on the inner perimeter 242 of the access orifice 240 and locks the inner lid in a closed position. The consumer may then disengage the outer lid latch 264 from the receiving notch for the inner lid latch 264 on the inner perimeter 242 of the access orifice 240 to open the inner lid 250. Such notches and latches are known in the art.

In particular embodiments, the inner lid 260 is attached to the perimetric flange 220 by any means that allows the outer lid to be reversibly moved from the open position to the closed position. Such means are known in the art, and include hinges (e.g., living hinges), flexible bands extending from the inner lid 260 to the perimetric flange 220, and chain-type linkages. As exemplified in FIGS. 1 through 4, the inner lid 260 is connected to the perimetric flange 220 by an inner lid hinge 262 having an inner lid hinge axis Y. In embodiments, the outer lid hinge axis X and the inner lid hinge axis Y may be orthogonal to one another, parallel to one another, or offset from one another at any angle therebetween.

In operation, the inner lid hinge 262 allows the inner lid 260 to be reversibly rotated around the inner lid hinge axis Y from the open position to the closed position and back. The hinge may include a mechanism that biases the inner lid 260 into either the open position or the closed position. Essentially, if the consumer leaves the inner lid 260 in a position between the open position and the closed position, then the inner lid 260 will automatically default the open position or the closed position, whichever is closest to the position the inner lid 260 is left by the consumer.

In particular embodiments, in a first condition, the dispensing orifice 230, the access orifice 240, or both may be sealed with a disposable seal (not shown), which seals the cleaning articles 400 within the housing 300 before a cleaning article 400 is dispensed the first time. Once the disposable seal (not shown) has been removed the dispensing orifice 230 and the access orifice 240 are unsealed allowing access to and dispensing of the cleaning articles 400.

Figure 3:
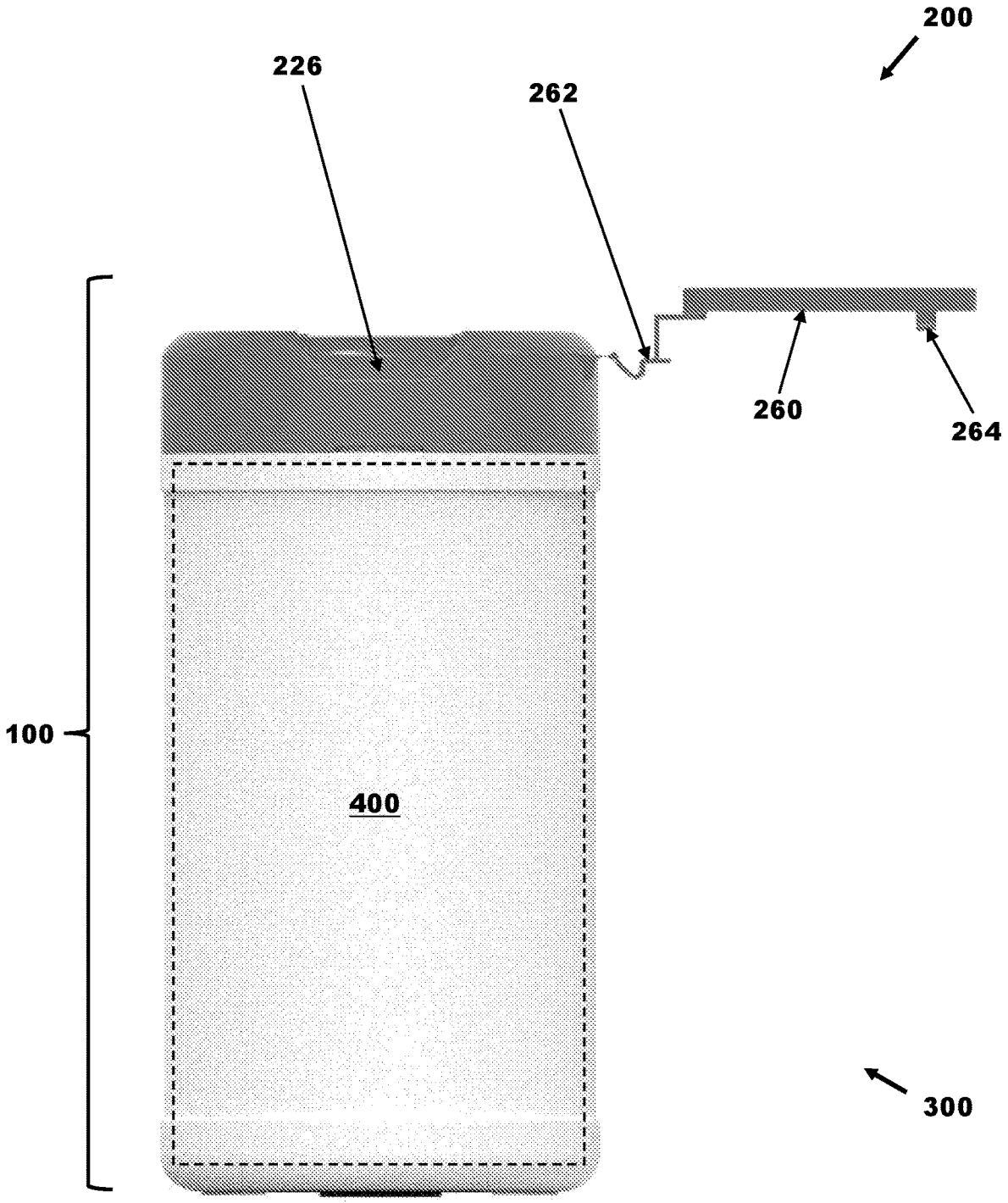
FIG. 3 representatively shows a perspective view of the sealing and dispensing structure with the inner lid and outer lid each in the open positions.
Figure 4:
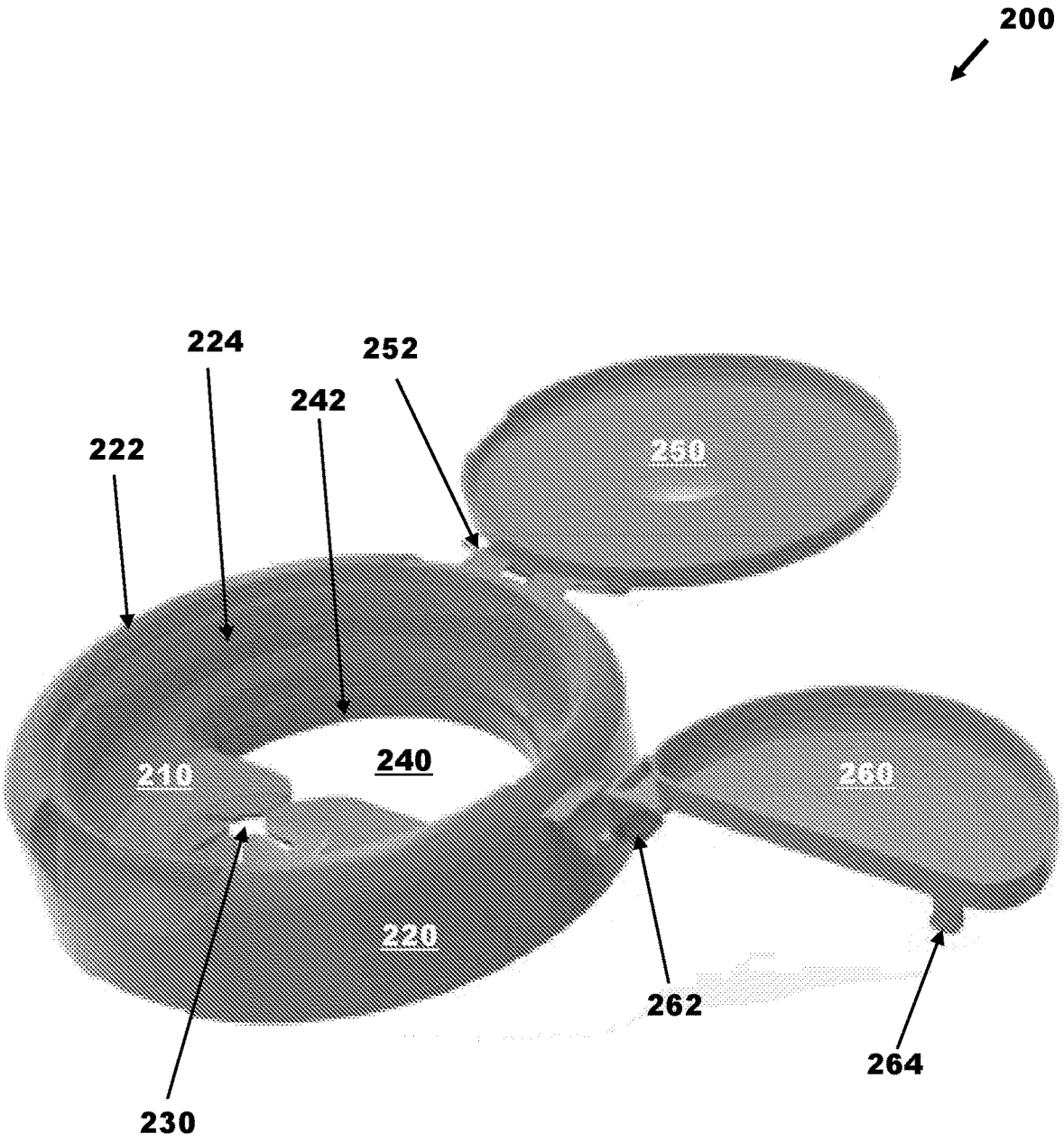
FIG. 4 representatively shows side view of the sealing and dispensing structure affixed to a housing with the inner lid in the open position.

In a second condition, the outer lid is in an open position and the inner lid is in an open position (FIGS. 1, 3 and 4). This second condition allows the user to access the cleaning articles 400 stored in the housing 300 by reaching through the access orifice 240 and into the housing 300 where the cleaning articles 400 are stored. In this condition, a person care article 400 may be drawn up and through the dispensing orifice 230 to move a leading edge a person care article 400 into the dispensing compartment 270.

The inner lid 260 may then be rotated around the inner lid hinge axis Y from an open position to a closed position. In this third condition, the inner lid 260 mates with and seals the access orifice 240 from the dispensing compartment 270, and thus, from the environment. In this condition, the interior of the housing 400 is exposed to the dispensing compartment 270, and thus, to the environment through ONLY the relatively small dispensing orifice 230. Moreover, only a leading edge of a single cleaning article 400 is exposed to the dispensing compartment 270, and thus, to the environment. Accordingly, there is a significant reduction (compared to the second condition and conventional containers) in the opportunity for the cleaning articles 400 in the housing 300 to be contaminated or to dry out.

After the use of one or more of the cleaning articles 400, the outer lid 250 may then be rotated around the inner lid hinge axis X from an open position to a closed position. In this fourth condition, the outer lid 250 mates with and seals the perimetric flange 220, and thus, seals the dispensing compartment 270 closed. In this manner the cleaning articles 400, including the single cleaning article 400 with its leading edge extending through the dispensing orifice 230, are completely sealed off from the environment.

When another cleaning article 400 is needed, the outer lid 250 may be rotated around the outer lid hinge axis X from the close position to the open position (i.e., back to the third condition) to allow access to the dispensing compartment. Likewise, if there is need to access the cleaning articles 400 stored in the housing 300 (e.g., if the cleaning articles 400 that was drawn through the dispensing orifice 230 falls back into the hosing 300), the inner lid 260 may be rotated around the inner lid hinge axis Y from the close position to the open position (i.e., back to the second condition) to allow access to interior of the housing 300.

In particular embodiments, a disposable seal (not shown) is provided. The disposable seal may be any means for sealing the dispensing orifice 230 and/or the access orifice 240 from the environment, and thus, sealing the cleaning articles 400 within the housing 300 before a cleaning article 400 is dispensed for the first time. The disposable seal (not shown) is discarded after removal. Disposable seals of this type are known in the art. Exemplary disposable seals include films, perforated portions of the floor, and shrink wraps. Preferably the disposable seal is a film adhered to the floor 210 of the sealing and dispensing structure 200 and covering and sealing the dispensing orifice 230 and the access orifice 240. It should be appreciated that the disposable seal may also cover the inner lid 260 if the inner lid 260 is in the closed position prior to first use of a person care article 400.

The housing 300 of the present invention can be made from various materials and in various configurations. The housing 300 can be made of a flexible or a rigid material and my have any shape suitable to contain and store the cleaning articles 400. The housing 300 may be a rigid open-topped cylinder with a solid bottom. The housing 300 may be a flexible pouch made of polyester film laminated to polyethylene film. The polyester film can be reverse printed, so the printing is between the two film layers. Alternatively, a single-ply surface printed film can be used. A single-ply film can be composed of one or more layers of polyolefin and in particular embodiments formed in a coextrusion.

In particular embodiments, the housing and the perimetric flange are unitary. As used herein, the term "unitary" means integral or forming a single structure. Essentially, the perimetric flange and the housing may be formed as a single piece which cannot be separated without destroying the integrity of the container. Thus, the housing may simply be a portion of the container adapted to contain the cleaning articles. In other embodiments, the housing and the perimetric flange are separate pieces, the perimetric flange is adapted to connect to the housing, and the perimetric flange and the housing are connected.

The cleaning articles 400, e.g., wipes or wet wipes, can be arranged in the housing 300 in any manner which provides convenient and reliable one at a time dispensing and which assists the wipes in not becoming dirty and/or overly dry. For example, the wipes may be arranged in the container in a spiral wound configuration as is known to those skilled in the art. Alternatively, the wipes may be arranged in the housing 300 as a continuous web of interconnected wipes which are folded in an accordion-like stacked configuration or a roll. The individual wipes can be connected together along lines of frangibility, such as lines of perforations, to ensure that the trailing wipe is in position for grasping by the user after the leading wipe is removed. For example, the wipes can be provided by a continuous web of material which has a series of lines of frangibility extending across the width of the web. In the alternative, the wipes may be arranged in the container as a plurality of individual sheets arranged in a stacked configuration to provide a stack of wipes which may or may not be individually folded. The wipes may be individual wipes which are folded in a c-fold, Z-fold, quarter fold or other zigzag fold or interfolded or non-interfolded configurations as are known to those skilled in the art. The cleaning articles 400 may include a plurality of wipes stacked one on top of each other in a non-interfolded configuration, for "reach-in' dispensing. The portion of the web of material between successive lines of frangibility provides each individual wipe. The lines of frangibility can be provided by means known to those skilled in the art such as perforations, indentations, or cuts in the web of material.

The container 100 of the present invention can include any suitable number of individual wipes depending upon the desired packaging and end use. For example, the container can be configured to include a stack of wipes which can include at least about 8 wipes and desirably from about 16 to about 320 individually wipes, and more desirably from about 16 to about 64 wipes. The size and shape of the roll or stack of wipes is dependent upon the size and shape of the container. Each wipe is in particular embodiments generally rectangular in shape and defines a pair of opposite side edges and a pair of opposite end edges which can be referred to as a leading end edge and a trailing end edge. The leading end edge of each wet wipe is typically positioned in the container 100 to be grasped by a user thought the access orifice 240 and drawn though the dispensing orifice 230 to facilitate a removal of a single the wipe from the container. The removal of one wipe through the dispensing orifice 230 acts to draw a leading edge of the next wipe through the dispending orifice 230 and into the dispensing compartment 270 where it is may reside and be accessible to the user when next wipe is needed.

Materials suitable for the wipes of the present invention are well known to those skilled in the art. For wet wipes, these can be made from any material suitable for use as a moist wipe, including meltblown, coform, air-laid, bonded-carded web materials, hydroentangled materials, high wet-strength tissue and the like, and can comprise synthetic or natural fibers or combinations thereof. The wipes of the different aspects of the present invention can contain a liquid which can be any solution which can be absorbed into the wipes, thus making them "wet wipes." The liquid contained within the wet wipes can include any suitable components which provide the desired wiping properties. For example, the components can include water, emollients, surfactants, preservatives, chelating agents, pH buffers, fragrances, or combinations thereof. The liquid can also contain lotions, ointments, and/or medicaments. The amount of liquid contained within each wet wipe can vary depending upon the type of material being used to provide the wet wipe, the type of liquid being used, the type of container being used to store the stack of wet wipes, and the desired end use of the wet wipe. Generally, each wet wipe can contain from about 150 to about 600 weight percent and desirably from about 200 to about 400 weight percent liquid based on the dry weight of the wipe for improved wiping. The housing 300 and/or sealing and dispensing structure 200 can be transparent or translucent to provide an indication of the quantity of wipes remaining in the container 100. The sealing and dispensing structure 200 and/or housing 300 can be made of any suitable material, including cardboard, paperboard, various polymers, copolymers, and mixtures, including, e.g., polyethylene, polypropylene, polyester, polystyrene, and other polymers, or composite materials.

Accordingly, the different aspects and features of the present invention can provide containers for wipes which, when compared to conventional containers for wipes, provide improved moisture retention, contamination prevention, and/or improved wipe dispensing. While the invention has been described in detail with respect to the specific aspects thereof, it will be appreciated that those skilled in the art, upon attaining an understanding of the foregoing, may readily conceive of alterations to, variations of, and equivalents to these aspects. Accordingly, the scope of the present invention should be assessed as that of the appended claims.

What is claimed is:

1. A sealing and dispensing structure for a container for storing and dispensing cleaning articles comprising:

a floor defining a bottom of the sealing and dispensing structure;

a perimetric flange adjoined to the floor at an interior bottom, the perimetric flange and the floor at least partially defining a side and a bottom of a dispensing compartment;

a dispensing orifice extending through the floor for individually dispensing the cleaning articles into the dispensing compartment;

an access orifice extending through at least a portion of the floor for accessing the cleaning articles stored in the container;

an outer lid having a size and shape adapted to mate with and seal an interior top of the perimetric flange and form a top of the dispensing compartment when in a closed position wherein the outer lid is connected to the perimetric flange by at least one outer lid hinge having an outer lid hinge axis, the at least one outer lid hinge allowing the outer lid to be reversibly rotated around the outer lid hinge axis between an open and closed position; and an inner lid having a size and shape adapted to mate with and seal the access orifice and form at least a portion of the bottom of the dispensing compartment when in a closed position such that the dispensing orifice is open while the inner lid is in the closed position and the outer lid is in an open position, wherein the dispensing orifice is uncovered by the inner lid when the inner lid in the closed position, wherein the inner lid is connected to the perimetric flange by at least one inner lid hinge having an inner lid hinge axis, the at least one inner lid hinge allowing the inner lid to be reversibly rotated around the inner lid hinge axis between an open position and the closed position, wherein the inner lid hinge axis is external to the perimetric flange such that the inner lid is configured to open outward and away from the access orifice, wherein the inner lid hinge includes a mechanism that biases the inner lid into either the open or closed position such that the inner lid will automatically default to the open position or the closed position, whichever is closest to the position the inner lid was left by a consumer; and wherein the outer lid hinge axis and the inner lid hinge axis are orthogonal to one another along an external surface of the perimetric flange.

2. A sealing and dispensing structure of claim 1, wherein the outer lid seals the interior top of the perimetric flange with a pressure seal or a friction seal.

3. A sealing and dispensing structure of claim 1, wherein the outer lid comprises a latch and the perimetric flange comprises a receiving notch adapted to receive the outer lid latch to reversibly lock the outer lid in the closed position.

4. A sealing and dispensing structure of claim 1, wherein the inner lid seals the access orifice with a pressure seal or a friction seal.

5. A sealing and dispensing structure of claim 1, wherein the inner lid comprises a latch and access orifice comprises a receiving notch adapted to receive the inner lid latch to reversibly lock the inner lid in the closed position.

6. A sealing and dispensing structure of claim 1, wherein the access orifice comprises greater than 30% of the surface area of the floor.

7. A sealing and dispensing structure of claim 1, wherein the ratio of the surface area of the access orifice to the dispensing orifice is about 5 to 1 or greater.

8. A container for storing and dispensing cleaning articles comprising a sealing and dispensing structure of claim 1 and a housing for storing the cleaning articles, wherein the perimetric flange is adapted to connect to the housing and the perimetric flange and the housing are connected or wherein the housing and the perimetric flange are unitary.

9. A container of claim 8, further comprising cleaning articles stored in the housing, the cleaning articles are selected from the group consisting of wet wipes, pre-moistened towelettes, and cleaning cloths.

10. A sealing and dispensing structure of claim 1, further comprising a disposable seal sealing the dispensing orifice, the access orifice, or both.

11. A sealing and dispensing structure of claim 1, wherein the floor defines a flat surface.

12. A sealing and dispensing structure for a container for storing and dispensing cleaning articles comprising:

a floor defining a bottom of the sealing and dispensing structure;

a perimetric flange around the floor, the perimetric flange having an exterior wall and an interior wall, the interior wall having an interior perimeter, a bottom, and a top, the floor adjoined to the perimetric flange at the bottom of the interior wall, the interior wall defining a circumference of a dispensing compartment and the floor at least partially defining a bottom of a dispensing compartment;

a dispensing orifice extending through the floor for individually dispensing the cleaning articles into the dispensing compartment;

an access orifice extending through at least a portion of the floor for accessing the cleaning articles stored in the container, the access orifice having an interior perimeter;

an outer lid connected to the perimetric flange by at least one outer lid hinge having an outer lid hinge axis, the at least one outer lid hinge allowing the outer lid to be reversibly rotated around the outer lid hinge axis between an open position and a closed position, the outer lid having a size and shape adapted to mate with the top of the interior perimeter of the interior wall and form a top of the dispensing compartment when in the closed position; and an inner lid connected to the perimetric flange by at least one inner lid hinge having an inner lid hinge axis, the at least one inner lid hinge allowing the inner lid to be reversibly rotated around the inner lid hinge axis between an open position and a closed position, inner lid hinge axis being external to the perimetric flange such that the inner lid is configured to open outward and away from the access orifice, the inner lid having a size and shape adapted to mate with the interior perimeter of the access orifice and form at least a portion of the bottom of the dispensing compartment when in the closed position such that the dispensing orifice is open while the inner lid is in the closed position and the outer lid is in an open position, wherein the dispensing orifice is uncovered by the inner lid when the inner lid in the closed position, wherein the inner lid hinge includes a mechanism that biases the inner lid into either the open or closed position such that the inner lid will automatically default the open position or the closed position, whichever is closest to the position the inner lid was left by a consumer; and wherein the outer lid hinge axis and the inner lid hinge axis are orthogonal to one another along an external surface of the perimetric flange.

13. A sealing and dispensing structure of claim 12, wherein the outer lid seals the interior top of the perimetric flange with a pressure seal or a friction seal.

14. A sealing and dispensing structure of claim 12, wherein the outer lid comprises a latch and the perimetric flange comprises a receiving notch adapted to receive the outer lid latch to reversibly lock the outer lid in the closed position.

15. A sealing and dispensing structure of claim 12, wherein the inner lid seals the access orifice with a pressure seal or a friction seal.

16. A sealing and dispensing structure of claim 12, wherein the inner lid comprises a latch and access orifice comprises a receiving notch adapted to receive the inner lid latch to reversibly lock the inner lid in the closed position.

17. A sealing and dispensing structure of claim 12, wherein the access orifice comprises greater than 30% of the surface area of the floor.

18. A sealing and dispensing structure of claim 12, wherein the ratio of the surface area of the access orifice to the dispensing orifice is about 5 to 1 or greater.

19. A container for storing and dispensing cleaning articles comprising a sealing and dispensing structure of claim 12 and a housing for storing the cleaning articles, wherein the perimetric flange is adapted to connect to the housing and the perimetric flange and the housing are connected or the housing and the perimetric flange are unitary.

20. A container of claim 19, further comprising cleaning articles stored in the housing, the cleaning articles are selected from the group consisting of wet wipes, pre-moistened towelettes, and cleaning cloths.

21. A sealing and dispensing structure of claim 12, further comprising a disposable seal sealing the dispensing orifice, the access orifice, or both.

* * * * *